United States Patent [19]

Zunkel

[11] Patent Number: 4,736,798

[45] Date of Patent: Apr. 12, 1988

[54] RAPID CYCLE ANNULUS PRESSURE RESPONSIVE TESTER VALVE

[75] Inventor: Gary D. Zunkel, Chickasha, Okla.

[73] Assignee: Halliburton Company, Duncan, Okla.

[21] Appl. No.: 864,163

[22] Filed: May 16, 1986

[51] Int. Cl.[4] ..... E21B 34/00

[52] U.S. Cl. ..... 166/321; 166/324; 166/336

[58] Field of Search ..... 166/320–325, 166/162, 169, 250, 264, 336, 373, 374, 386

[56] References Cited

U.S. PATENT DOCUMENTS

| | | | |
|---|---|---|---|
| 3,856,085 | 12/1974 | Holden et al. . | |
| 3,915,228 | 10/1975 | Giebeler . | |
| 4,109,724 | 8/1978 | Barrington . | |
| 4,109,725 | 8/1978 | Williamson et al. . | |
| 4,113,012 | 9/1978 | Evans et al. | 166/321 X |
| 4,341,266 | 7/1982 | Craig . | |
| 4,355,685 | 10/1982 | Beck . | |
| 4,403,659 | 9/1983 | Upchurch | 166/321 X |
| 4,422,506 | 12/1983 | Beck . | |
| 4,429,748 | 2/1984 | Beck . | |
| 4,444,267 | 4/1984 | Beck . | |
| 4,444,268 | 4/1984 | Barrington . | |
| 4,537,258 | 8/1985 | Beck . | |
| 4,557,333 | 10/1985 | Beck . | |
| 4,633,592 | 1/1987 | Ringgenberg | 166/336 |
| 4,667,743 | 5/1987 | Ringgenberg et al. | 166/240 X |

*Primary Examiner*—Stephen J. Novosad
*Assistant Examiner*—David J. Bagnell
*Attorney, Agent, or Firm*—Joseph A. Walkowski

[57] ABSTRACT

The present invention comprises a rapid cycle tester valve operable in response to annulus pressure. The tester valve includes a valve ball rotatable between open and closed positions through an operating mechanism which includes a ball and slot ratchet mechanism for selectively transmitting operating movement from a pressure responsive slidable valve housing through a mandrel assembly. The valve housing employs back to back check valves disposed in a longitudinal valve passage to create pressure differentials to move the valve housing in response to annulus pressure increases and decreases.

5 Claims, 6 Drawing Sheets

RAPID CYCLE ANNULUS PRESSURE RESPONSIVE TESTER VALVE

BACKGROUND OF THE INVENTION

The present invention relates to an improved annulus pressure responsive tester valve for use in the flow testing of oil and gas wells.

Various tester valves, circulation valves and sampler valves for testing oil and gas wells have been developed which are responsive to changes in the annulus pressure of the fluid between the well bore and the testing string for the opening and closing of the various valves. These various annulus pressure responsive valves are useful, particularly in offshore testing operations, where it is desired to manipulate the various valves in the testing string without utilizing reciprocation or rotation of the testing string, and thus allows the blowout preventors to remain closed about the testing string during the test.

The assignee of the tester valve of the present invention has recently developed an annulus pressure responsive tester valve which operates in response to a relatively low annulus pressure increase and decrease; this tool is shown in U.S. Pat. Nos. 4,422,506 and 4,429,748. These low pressure responsive tools have a power piston which is exposed to well annulus pressure at its upper end, and which has its lower end exposed to pressurized nitrogen gas in a nitrogen chamber located therebelow in the tool. Located below the nitrogen chamber is a metering chamber or equalizing chamber filled with oil. A floating piston separates the gas in the gas chamber from the oil in the metering chamber. Disposed in the metering chamber is a metering cartridge which provides a resistance to flow of the oil therethrough. The lower end of the metering chamber below the metering cartridge is communicated with well annulus pressure, and a second floating piston separates the oil in the metering chamber from well fluid which enters the lower end of the metering chamber. An increase in annulus pressure is immediately communicated to the upper surface of the power piston, but is delayed for a significant period of time in being fully communicated to the lower side of the power piston, so that a rapid increase in well annulus pressure will cause a downward pressure differential across the power piston to move the power piston and actuate the tool.

A number of modifications of the basic low pressure responsive tool have been developed by the assignee of the present invention as illustrated in U.S. Pat. No. 4,537,258.

One particular feature of such tools to which many of the alternative designs developed by the assignee of the present invention have been directed is the provision of a means for controlling the position of the tester valve during changes in annulus pressure. That is, while the normal operation of the tool provides for opening and closing of the ball valve in response to reciprocating motion of the power piston, it is sometimes desired to be able to maintain the ball valve in either a closed or an open position during changes in annulus pressure. There are several reasons why this feature is desirable. For example, the operator may wish to run the tool into the well with the ball valve in an open position in order to fill the testing string as it is run into the well. Also, it may be desired to pressure test the annulus after the testing string is in position without opening the testing valve. Numerous approaches have been utilized to control movement of the ball valve in a testing tool.

For example, an actuating mandrel associated with the ball valve may be initially shear pinned in place to hold the valve closed while running into a well, as shown for example in FIG. 2B of U.S. Pat. No. 4,422,506.

U.S. Pat. No. 4,429,748 shows in FIG. 2C thereof a resilient ring assembly 206 to positively control the full opening and closing of the ball valve such that the ball valve is prevented from only partially opening or closing.

U.S. Pat. No. 4,537,258 discloses several embodiments of such tools. The embodiment disclosed in FIGS. 2A–2E and FIG. 3 thereof utilizes a lug and slot arrangement disposed between the power piston and the housing for controlling movement of the power piston relative to the housing. The embodiment disclosed in FIGS. 5A–5G thereof uses a spring loaded pin and detent arrangement 600 for locking the actuating mandrel in a position corresponding to an open position of the ball valve.

U.S. Pat. No. 4,355,685 shows a circulating valve having an annulus pressure responsive operating means similar to that of the tools just discussed, and including a lug and slot arrangement disposed between the power piston and the housing as seen in FIG. 1C and FIG. 4 thereof for controlling the position of the power piston relative to the housing. Another device recently developed by the assignee of the present invention is a multimode testing tool shown in U.S. Pat. 4,633,592. It is noted that the aforesaid, '592 patent is itself not prior art to the present invention; that application is being referred to only as a convenient means for describing one embodiment of the tool shown therein which is a part of the prior art. U.S. Pat. No. 4,633,592 shows several embodiments of a ratchet means for operably connecting an actuating mandrel to a power piston but only the embodiment shown in FIG. 10 thereof is a part of the prior art. The ratchet means disclosed in FIG. 10 in '592 patent is similar in some respects to the ratchet means utilized in the tester valve of the present invention.

SUMMARY OF THE INVENTION

The present invention comprises a rapid cycle annulus pressure responsive tester valve. The tool of the present invention is operated by a ball and slot type ratchet mechanism which provides the desired opening and closing of a ball valve in response to a sequence of annulus pressure increases and decreases. The opening and closing of the ball valve is effected without requiring the accurate monitoring of pressure levels such as may be necessary with tools that employ multiple pressure levels above a reference level or both pipe string and annulus pressures to actuate. In addition, the tool of the present invention is not limited to a given number of opening and closing cycles, unlike prior art tools which employ shear pins. The tool of the present invention further provides the ability to maintain the ball valve in the open or closed position through several cycles of annulus pressure increase and decrease. Finally, the tool of the present invention avoids the use of fluid metering systems of the prior art such as are employed in many of the aforesaid patents, fluid metering systems being susceptible to clogging and dependent for proper operation upon a high quality, known viscosity fluid to meter. Elimination of a fluid metering system also greatly reduces tool cycling time and avoids the effect of temperature-induced viscosity changes in the metered fluid, as well as providing enhanced reliability. Furthermore, the elimination of a metering system also renders the tool of the present invention much more responsive to annulus pressure changes in wells which contain thick, debris laden, or other "dirty" annulus fluids, all of which tend to retard or damp the effect of changes in annulus pressure applied from the top of the well bore.

Finally, in deep, hot wells it takes too long for the full pressure increase as applied at the surface to develop at the location of a tester valve with a fluid metering system, because the tool's metering system balances the pressure on both sides of its power piston as fast as the annulus pressure increase reaches the tool, and which doesn't function as there is no pressure differential to operate it.

BRIEF DESCRIPTION OF THE DRAWINGS

The advantages of the present invention will be more fully understood from the following description and drawings wherein.

OVERALL WELL TESTING ENVIRONMENT

Figure 1:
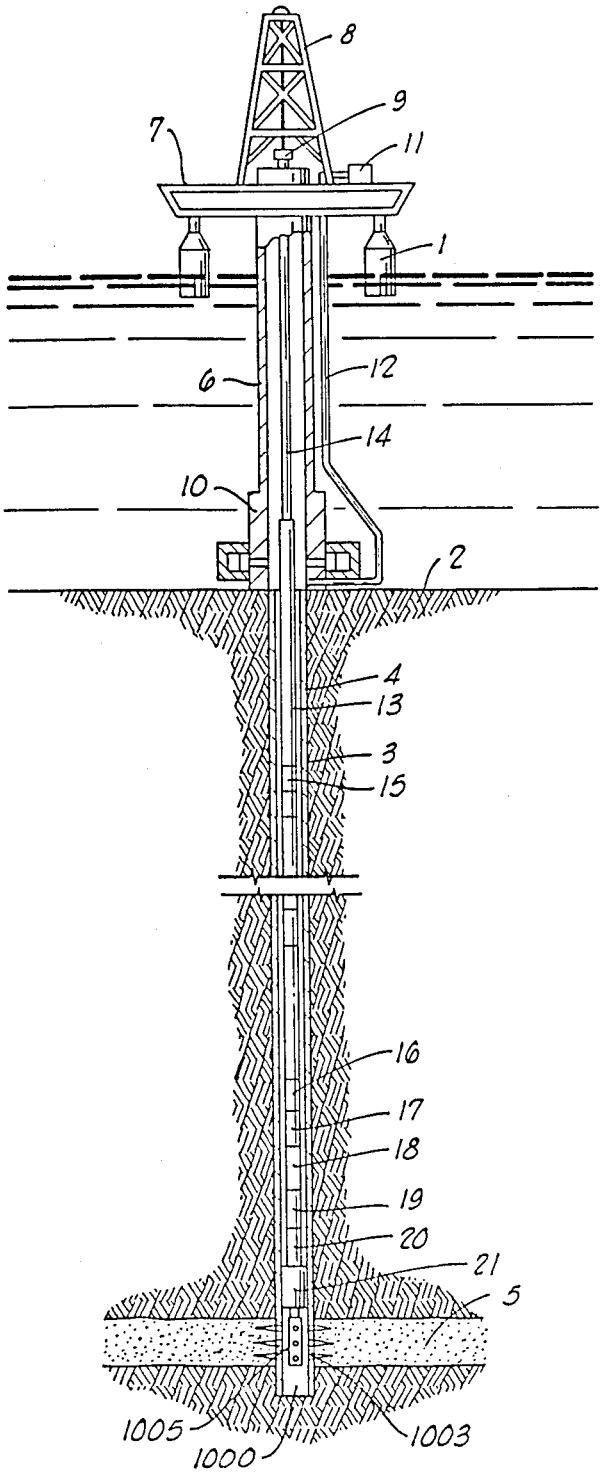
FIG. 1 provides a schematic vertically sectioned view of a representative offshore installation which may be employed for testing purposes and illustrates a formation testing "string" or tool assembly in position in a submerged well bore and extending upwardly to a floating operating and testing station.

Referring to FIG. 1 of the present invention a testing string for use in an offshore oil or gas well is schematically illustrated. In FIG. 1, a floating work station 1 is centered over a submerged oil or gas well located in the sea floor 2 having a well bore 3 which extends from the sea floor 2 to a submerged formation 5 to be tested. The well bore 3 is typically lined by steel casing 4 cemented into place. A subsea conduit 6 extends from deck 7 and the floating work station 1 into a well head installation 10. The floating work station 1 has a derrick 8 and a hoisting apparatus 9 for raising and lowering tools to drill, test, and complete the oil or gas well. A testing string 14 is being lowered in the well bore 3 of the oil or gas well. The testing string includes such tools as one or more pressure balanced slip joints 15 to compensate for the wave action of the floating work station 1 as the testing string is being lowered into place, a circulation valve 16, a tester valve 17 of the present invention and a sampler valve 18. The positions of the latter two valves in the string may be reversed, if desired.

The slip joint 15 may be similar to that described in U.S. Pat. No. 3,354,950 to Hyde. The circulation valve 16 is preferably of the annulus pressure responsive type and may be as described in U.S. Pat. Nos. 3,850,250 or 3,970,147. The circulation valve 16 may also be of the reclosable type as described in U.S. Pat. No. 4,113,012 to Evans et al.

The tester valve 17 is preferably of the type of the present invention.

The sampler valve may employ two longitudinally spaced ball valves as is known in the art, or may be of the type disclosed in U.S. patent application Ser. No. 848,428, assigned to the assignee of the present invention.

A check valve 19 is described in U.S. Pat. No. 4,328,866 which is annulus pressure responsive may be located in the testing string below the sampler valve 18. Circulation valve 16, tester valve 17, sampler valve 18, and check valve 19 are operated by fluid annulus pressure exerted by pump 11 on the deck of the floating work station 1. Pressure changes are transmitted by pipe 12 to the well annulus 13 between the casing 4 and testing string 14. Well annulus pressure is isolated from the formation 5 to be tested by a packer 21 set in the well casing 4 just above the formation 5. The packer 21 may be a Baker Oil Tools Model D Packer, the Otis Engineering Corporation Type W Packer, the Halliburton Services EZ Drill® SV Packer or other packers well known in the well testing art.

The testing string includes a tubing seal assembly 20 at the lower end of the testing string which "stings" into or stabs through a passageway through the production packer 21 for forming a seal isolating the well annulus 13 above the packer 21 from an interior bore portion 1000 of the well immediately adjacent the formation 5 and below the packer 21.

Check valve 19 relieves pressure built up in testing string 14 below tester valve 17 as seal assembly 20 stabs into packer 21.

A perforating gun 1005 may be run by a wireline 2 or may be disposed on a tubing string at the lower end of testing string 14 to form perforations 1003 in casing 4, thereby allowing formation fluids to flow from the formation 5 into the flow passage of the testing string 14 via perforations 1003. Alternatively, the casing 4 may have been perforated prior to running testing string 14 into the well bore 3. A formation test controlling the flow of fluid from the formation 5 through the flow channel of the testing string 14 by applying and releasing fluid annulus pressure to the well annulus 13 by pump 11 to operate circulation valve 16, tester valve 17, sampler valve 18 and check valve 19 and measuring of the pressure buildup curves and fluid temperature curves with appropriate pressure and temperature sensors in the testing string 14 is fully described in the aforementioned patents.

DETAILED DESCRIPTION OF THE PREFERRED EMBODIMENT

Referring to FIGS. 2A–2G and 3 of the drawings, tester valve 17 of the present invention is shown to comprise a tubular housing assembly incorporating a ball valve therein, which ball valve is operated by an actuating mechanism substantially immediately responsive to changes in the pressure of the well bore annulus outside of the tool.

Figure 2A:
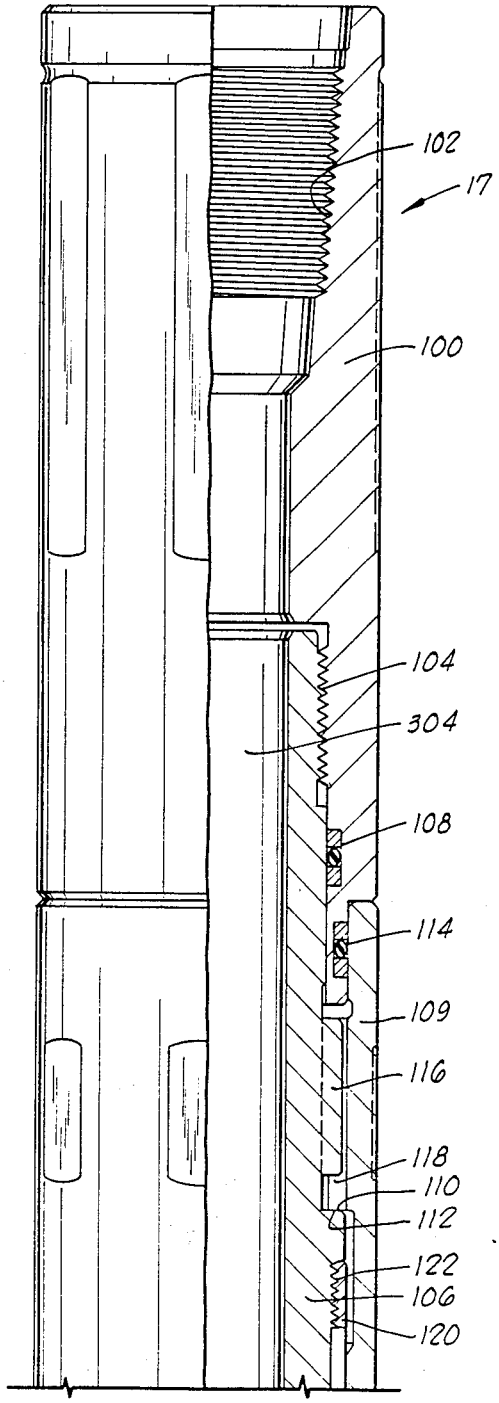
FIGS. 2A–2G comprise a vertical quarter section elevation of the tester valve of the present invention.
Figure 2B:
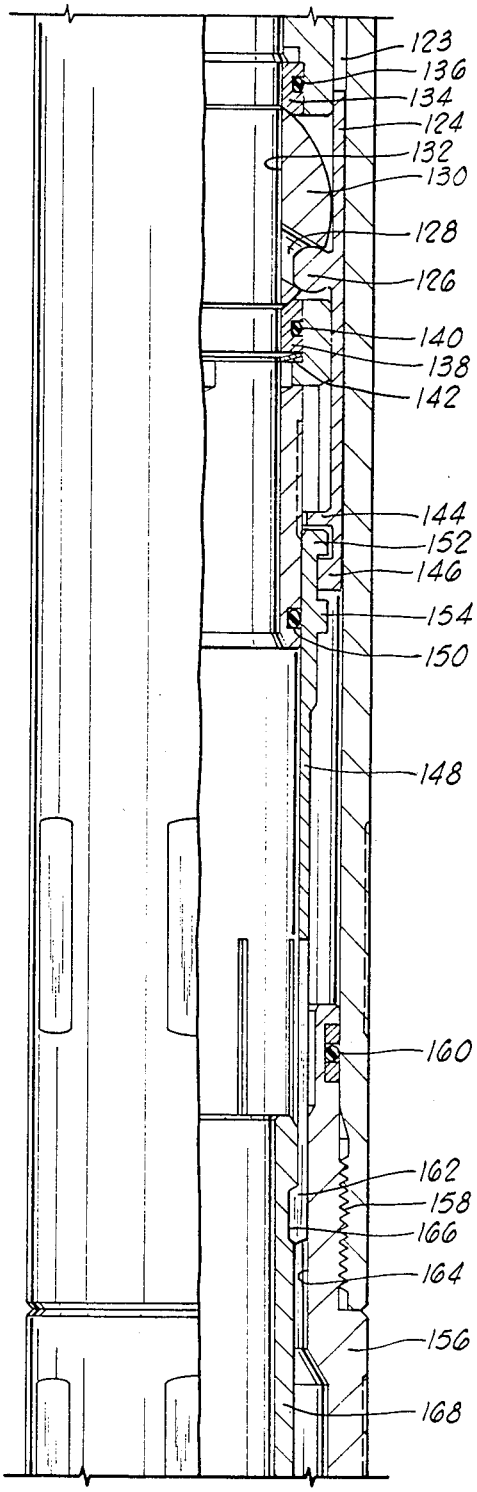
Figure 2C:
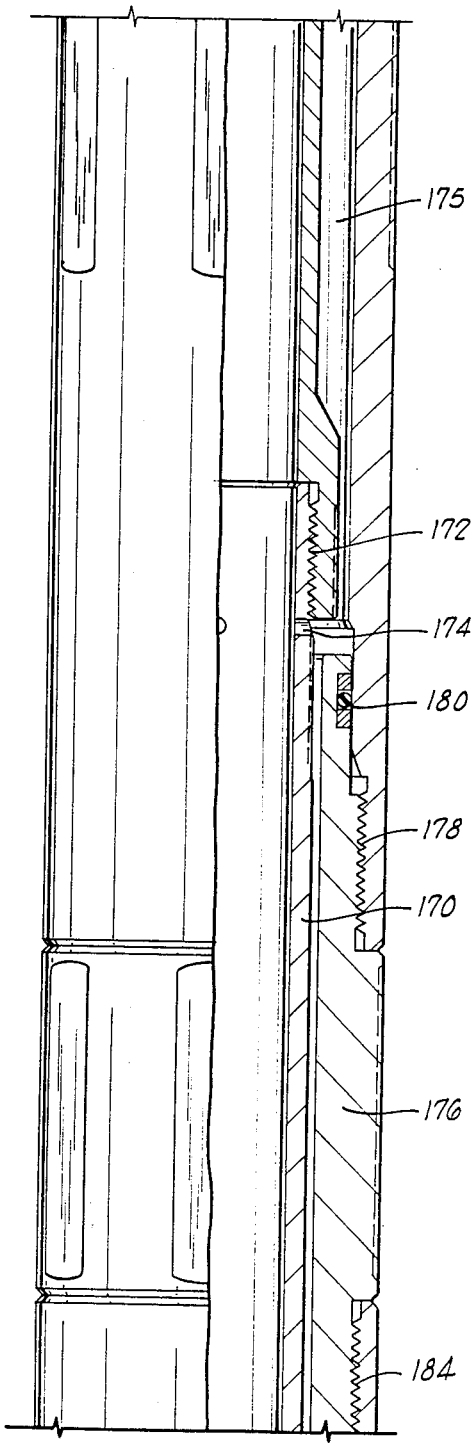
Figure 2D:
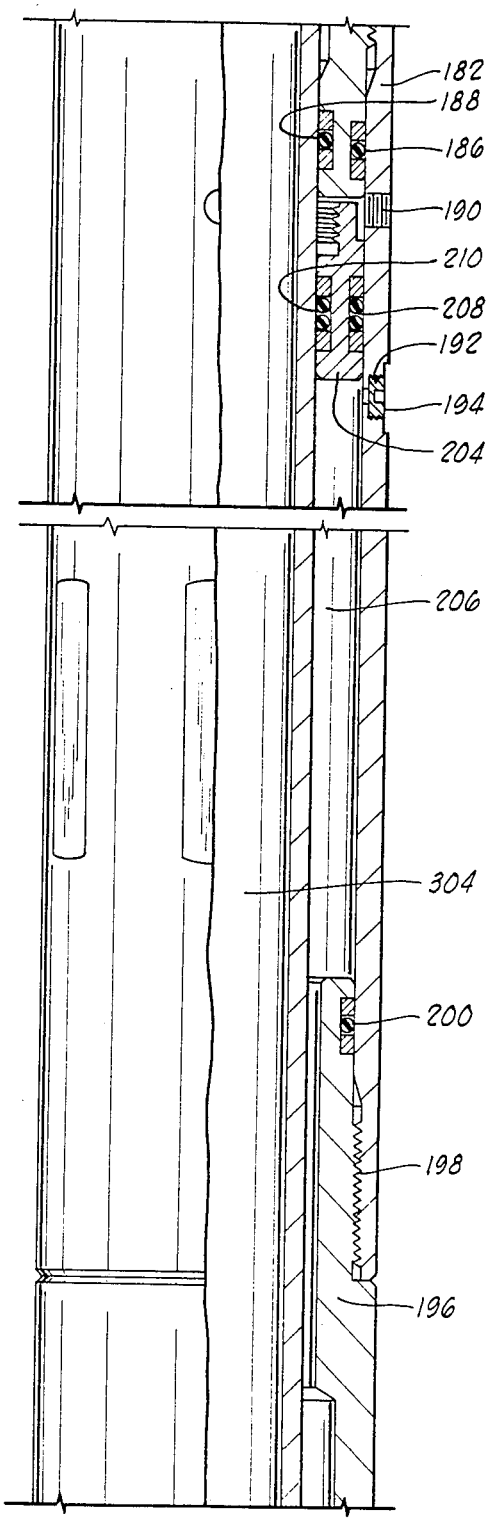
Figure 2E:
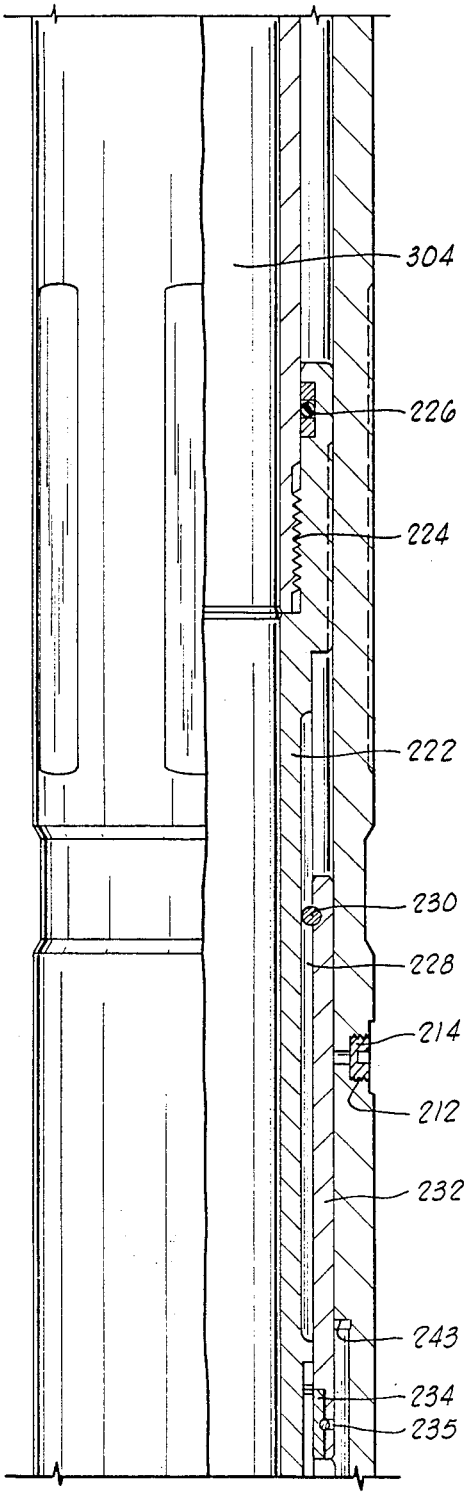
Figure 2F:
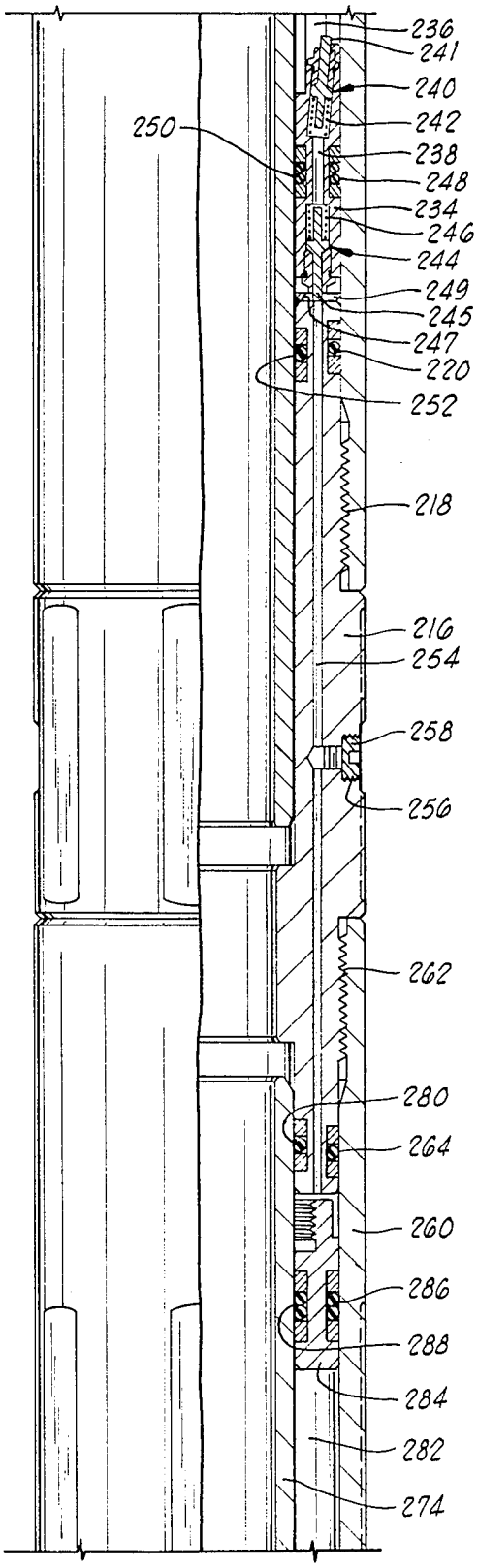
Figure 2G:
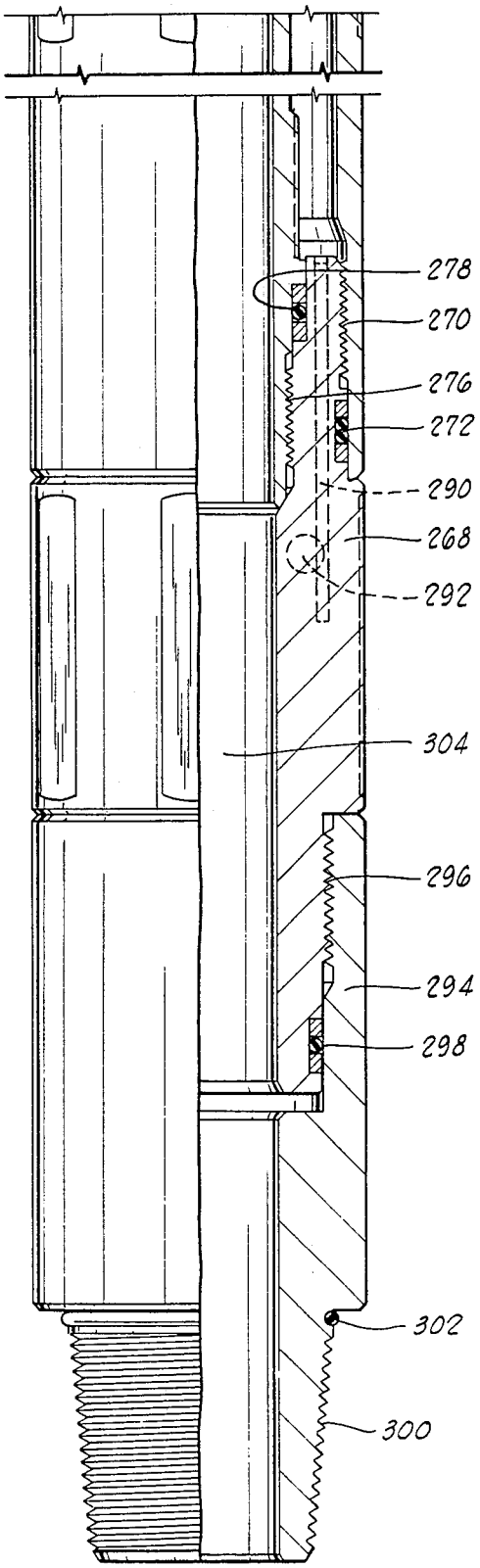

Commencing with FIG. 2A at the upper end of the tool as it would be normally disposed in a well bore, tubular upper adapter 100 provides internal threads 102 by which tester valve 17 of the present invention may be secured to a testing string extending thereabove in the well bore. Upper adapter 100 is secured to valve ball support 106 at threaded connection 104, seal assembly 108 effecting a fluid and pressure tight seal therebetween. Ball valve case 109 surrounds ball support 106, and surrounds the lower annular edge of upper adapter 100, whereat seal assembly 114 effects a fluid and pressure tight seal. Case 109 is maintained against upper adapter 100 through the contact of upwardly facing annular shoulder 110 on ball support 106 with the lower, radially flat edges 110 of inwardly radially extending splines 118 on case 109, which, through their engagement with radially outwardly extending splines 116 on ball support 106, prevent relative rotation between ball support 106 and case 109. Ball housing 120, of substantially tubular configuration, is secured to ball support 106 at threaded connection 122. The upper extent of ball housing 120 overshoots the lower end of ball support 106, and possesses two longitudinally extending windows 123 immediately below threaded connection 122. These windows 123, in cooperation with the exterior of ball support 106 and the interior of ball valve case 109 provide channels in which ball operating arms 124 may longitudinally reciprocate.

Arms 124 each include radially inwardly protruding lugs 126, which are accommodated an apertures 128 in valve ball 130, having a diametrical bore 132 therethrough.

Valve ball 130 is disposed between upper valve seat 134 and lower valve seat 138, the former of which lies in a downwardly facing arcuate recess at the lower end of ball support 106 and the latter of which lies in an upwardly facing arcuate recess on the interior of ball housing 120. A seal between upper ball seat 134 and ball support 106 is effected by O-ring 136 disposed in a recess on the exterior of upper ball seat, while lower ball seat 138 possesses a recess accommodating O-ring 140, which seals against ball housing 120. Below lower ball seat 138, Belleville spring 142 provides a constant bias for lower seat 138 against valve ball 130 and in turn against upper seat 134.

The lower end of each operating arm 124 includes radially inwardly extending protrusions 144 and 146 which engage the upper end of collet sleeve 148 via the interaction of radially outwardly extending flanges 152 and 154 therewith. Operating arms 124 and collet sleeve 148 are maintained in radial engagement between the lower exterior of ball housing 120 and the interior of case 109. O-ring 150, located on the lower exterior of ball housing 120 provides a wiping action against the interior of collet sleeve 148 when the latter is reciprocated.

For a more detailed disclosure of the construction of the ball valve assembly employed in the present invention, the reader may refer to U.S. Pat. No. 4,444,267 to Beck, the disclosure of which is hereby incorporated herein by reference.

Extension case 156 is secured to valve ball case 109 at threaded connection 158, with seal assembly 160 disposed therebetween. The upper end of extension case 156 possesses a reduced inner diameter 164, which maintains inwardly protruding lugs 162 at the bottom of collet sleeve 148 in annular recess 166 on the exterior of tubular extension mandrel 168, but permits disengagement of tubular extension mandrel 168 when recess 166 is moved above reduced inner diameter 164. Extension mandrel 168 is secured to power mandrel 170 at threaded connection 172, radial ports 174 extending through the wall of power mandrel 170 so as to accommodate changes in the volume of annular chamber 175 defined between extension case 156 and extension mandrel 168. Adapter nipple 176 is secured to extension case 156 at threaded connection 178, with seal assembly 180 disposed therebetween. Upper oil chamber case 182 is secured to the lower end of nipple 176 at threaded connection 184, with seal assembly 186 disposed therebetween. Seal assembly 188 on the interior of nipple 176 bears against and seals against the exterior of power mandrel 170. A plurality of radially oriented power ports 190 extend through the wall of upper oil chamber case 182, below which is disposed upper oil vent port 192, which is normally closed by plug 194.

Lower oil chamber case 196 is secured to upper oil chamber case 182 at threaded connection 198, with seal assembly 200 disposed between the two components.

An annular space is defined between upper oil chamber case 182 and the exterior of power mandrel 170. Annular upper floating piston 204 is disposed in this space and defines the upper extent of oil chamber 206, which is filled with a suitable fluid such as silicone oil. Piston 204 possesses outer and inner seal assemblies 208 and 210, respectively, which provide a sliding seal against both the interior of case 182 and the exterior of power mandrel 170.

Figure 3:
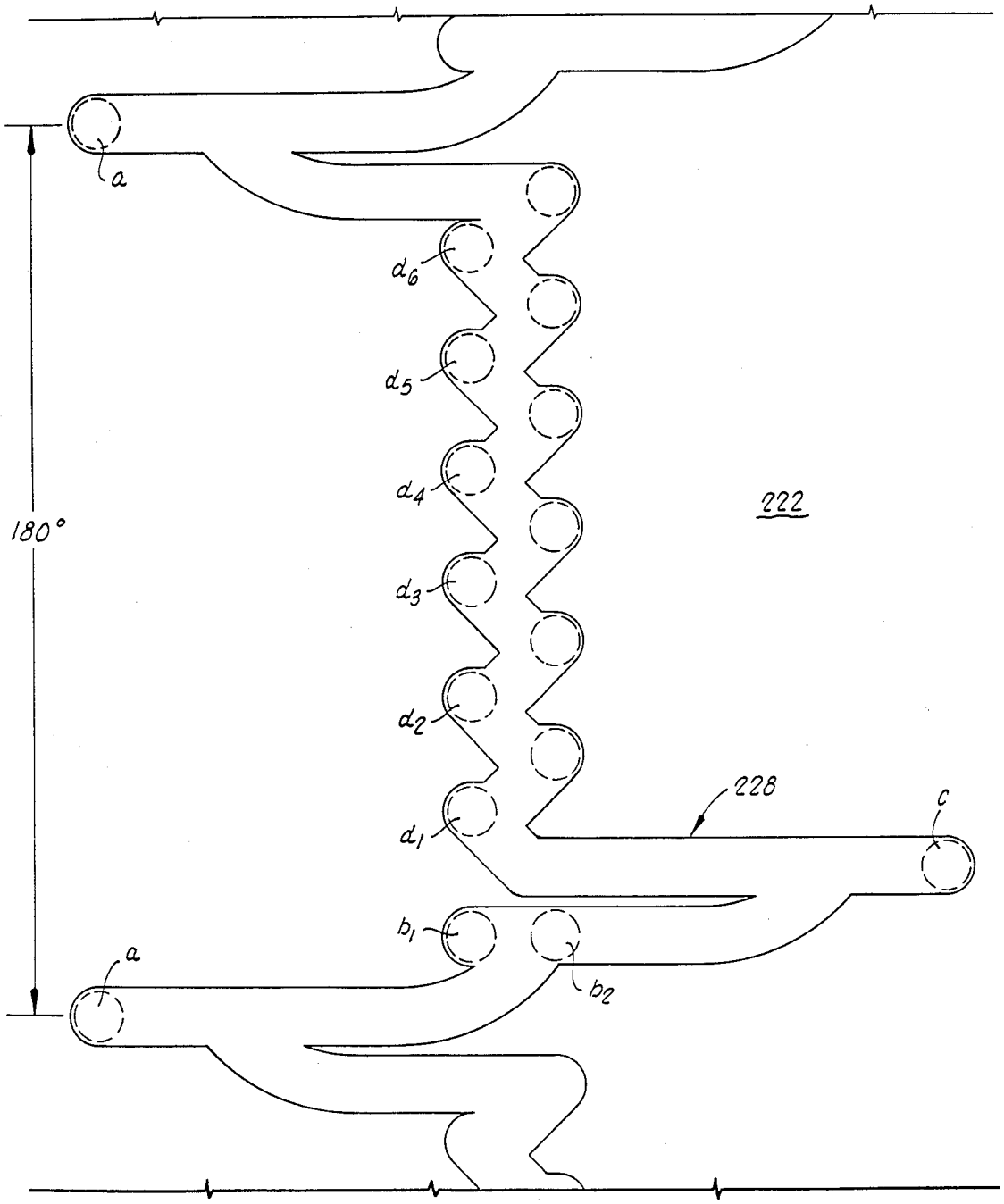
FIG. 3 comprises a development of the ratchet pattern employed in the tester valve of the present invention.

An oil fill port 212 extends through the wall of lower oil chamber case 196, and is normally closed by plug 214. Vent nipple 216 is secured to the lower end of lower oil chamber case 196 at threaded connection 218, and carries seal assembly 220 on the upper exterior thereof, which effects a fluid-tight seal against the interior of case 196. Ratchet mandrel 222 is disposed within lower oil chamber case 196 and vent nipple 216, ratchet mandrel 222 being secured to power mandrel 170 at threaded connection 224, seal assembly 226 effecting a fluid-tight seal between the two components. Ratchet mandrel 222 includes a continuous ratchet slot 228 of semi-circular cross-section on the exterior thereof, a development of which is shown in FIG. 3 of the drawings.

A tubular swivel mandrel 232 including two diametrically opposed hemispherical shaped ball seats, each of which contain a ratchet ball 230 which extends into ratchet slot 228, is disposed about ratchet mandrel 222.

Valve housing 234 extends below swivel mandrel 232, and is secured thereto at swivel bearing race 235 by a plurality of bearings which permit relative rotation, but not relative longitudinal movement, between the two components.

Valve housing 234 is annular in shape, and possesses a plurality of longitudinally extending windows 236 through the wall thereof at its upper end. Each of the windows 236 is aligned with a longitudinally extending valve passage 238, having at its upper end a spring-loaded check valve 240 having a slightly oblique orientation to the axis of tester valve 17. At the top of each check valve 240 is a valve stem 241 protruding into window 236. At the lower end of each check valve 240 is spring 242, serving to bias check valve 240 upwardly to a closed condition. Check valves 240 are opened upon contact of stems 241 with annular shoulder 243 on the interior of lower oil chamber case 196, as will be explained hereafter in conjunction with a description of the operation of the present invention.

At the lower end of each valve passage 238 is a second check valve assembly 244, of similar construction to valves 240. Check valves 244 each possess a longitudinally downwardly extending valve stem 245, which biases valve 244 toward an open position against the action of spring 246 when stem 245 contacts the upper edge 247 of vent nipple 216. A slot 249 is cut in the lower end of valve housing 234 intersecting the lower end of each valve passage 238 to prevent fluid lock between valve housing 234 and vent nipple 216. An outer seal assembly 248 surrounds valve housing 234 and provides a sliding fluid-tight seal between valve housing 234 and the interior of lower oil chamber case 196. Similarly an inner seal assembly 250 provides a sliding seal between the exterior of ratchet mandrel 222 and the interior of valve housing 234. Below valve housing 234, yet another seal assembly 252 provides a sliding seal between the interior of vent nipple 216 and the exterior of ratchet mandrel 222. Vent nipple 216 includes a plurality of diametrically opposed longitudinally extending oil passages therethrough, each of which is intersected by an oil vent port 256, which is normally closed by a plug 258.

Nitrogen chamber case 260 is secured to the lower end of vent nipple 216 at threaded connection 262, seal assembly 264 providing a seal between the two components. Nitrogen fill nipple 268 is secured to the lower end of nitrogen chamber case 260 at threaded connection 270, with seal assembly 272 providing a gas-tight seal between the two components. Nitrogen chamber mandrel 274 extends from vent nipple 216 and downwardly to nitrogen fill nipple 268 inside of case 260. Mandrel 274 is secured to nipple 268 at threaded connection 276, and seal assembly 278 is disposed therebetween. Seal assembly 280 on the lower interior of nipple 216 provides a seal between that component and the exterior of mandrel 274. An annular nitrogen chamber 282 is defined between the interior of case 260 and the exterior of mandrel 274, the lower end of vent nipple 216 and the upper end of nitrogen fill nipple 268. Annular lower floating piston 284 is disposed in chamber 282 defining the lower end of oil chamber 206, and providing a sliding sealing barrier between pressurized nitrogen therebelow and the silicone oil thereabove. Floating piston 284 includes an outer seal assembly 286 to provide sliding seal against the interior of case 260, and an inner seal assembly 288 to provide a sliding seal against the exterior of mandrel 274. Longitudinal nitrogen fill passage 290 extends longitudinally downward into nipple 268 from chamber 282, and is traversed by laterally oriented nitrogen fill passage 292 in which is disposed a nitrogen fill valve assembly such as is well known in the art.

Lower adapter 294 is secured to nitrogen fill nipple 268 at threaded connection 296, seal assembly 298 providing a seal between the two components. At the lower end of lower adapter 294, external tool joint pin threads provide a means by which lower components in the testing string may be secured to tester valve 17, O-ring 302 above threads 300 providing a seal therewith.

As can readily be seen, when valve ball 130 is in its open position, a "full open" or unrestricted bore 304 extends from the top to the bottom of tester valve 17, providing an unimpeded path for formation fluids, wireline instrumentation, perforating guns, etc.

It should be understood that before running tester valve 17 in a test string, oil chamber 206 between upper floating piston 204 and lower floating piston 284 is filled with a suitable liquid, such as silicone oil, through oil fill port 212, vent ports 192 and 256 being opened during filling to assure displacement of any air in the aforesaid annular space. Ports 212, 192 and 256 are then closed with plugs 214, 194 and 258, as previously noted. Likewise, nitrogen chamber 282 is filled in a manner well known in the art with pressurized nitrogen to provide a biasing force to lower floating piston 284 and, therefore, to the silicone oil on the other side thereof. The proper nitrogen pressure is generally dependent upon the well depth to which tester valve 17 is to be run, and is readily ascertainable by those of ordinary skill in the art.

OPERATION OF THE PREFERRED EMBODIMENT OF THE PRESENT INVENTION

Referring to FIGS. 1–3, operation of the tester valve 17 of the present invention is hereafter described.

As tester valve 17 is run into the well in testing string 14, it may have valve ball 130 in either an open or a closed position. The position of valve ball 130, is, of course, dependent upon the relative position of balls 230 in ratchet slot 228 of ratchet mandrel 222.

For purposes of illustration, let us assume that the tester valve 17 will be run into the well bore with valve ball 130 in its open position, as shown in FIG. 2A. With respect to FIG. 3, ratchet balls 230 will be in positions a in slot 228 (only a full 180° of which is illustrated in FIG. 3) as tester valve 17 is run into the well bore.

As tester valve 17 travels down to the level of formation 5 to be tested, at which position packer 21 is set, upper floating piston 204 moves downward under hydrostatic pressure, compressing the nitrogen in nitrogen chamber 282 via displacement of oil in oil chamber 206. This oil displacement acts on valve housing 234 and lower floating piston 284, both of which move downward. At this point, ratchet balls 230 have moved downwardly into slot 228 to positions $b_2$, since swivel mandrel 232 is secured to valve housing 234. Valve ball 130 remains in its open position, as balls 230 ride freely in slot 228, and have not made contact with a slot end. When valve housing 234 reaches shoulder 247 on vent nipple 216, valve stems 245 contact shoulder 247 and open check valves 244, dumping fluid (oil) to the lower side of valve housing 234 and equalizing pressure on both sides thereof, Pressure may then be increased in well annulus 13 by pump 11 via pipe 12. This increase in pressure is transmitted through pressure ports 190 to upper floating piston 204, which acts upon the fluid in chamber 206, opening check valves 240 and further displacing it through open check valves 244 of valve housing 234. Since valve housing 234 has already reached the lower extent of its travel, balls 230 remain at positions $b_2$ in slot 228 and the pressure is equalized on both sides of valve housing 234. When the annulus pressure is relieved, closed check valves 240 trap the higher pressure below valve housing 234, the higher pressure then causing valve housing 234 to move upward in oil chamber 206, moving swivel mandrel 232 and ratchet balls 230 upward, balls 230 shouldering in slot 228 at positions $b_1$, and the continued upward movement of valve housing 234 causes ratchet mandrel 227, power mandrel 170, extension mandrel 168, collet sleeve 148 and ball actuating arms 124 to move upwardly in tester valve 17, arms 124 rotating valve ball 130 through lugs 126 to a closed position, blocking tool bore 304. Movement of valve housing 234 is stopped when valve stems 241 of check valves 240 contact shoulder 243 on lower oil chamber case 196, dumping fluid to the upper side of housing 234 and thereby equalizing pressures on both sides thereof.

When annulus pressure is again increased, valve housing 234 moves downward due to closed check valves 244 trapping the lower, pre-increase annulus pressure therebelow in the tool, moving ratchet balls 230 downward in slot 228 to position c. Balls 230 do not shoulder because, when valve housing 234 reaches shoulder 247 on vent nipple 216, valve stems 245 contact shoulder 247 and open check valves 244, dumping fluid (oil) to the lower side of valve housing 234 and equalizing pressure on both sides thereof, stopping movement of swivel mandrel 232 and therefore of balls 230 in slot 228. As the length of the slot is greater than the travel of the ball sleeve assembly, balls 230 stop short of the slot end and valve ball 130 remains unmoved, in its closed position.

As annulus pressure is subsequently bled off, the pressurized nitrogen in chamber 282 pushes upwardly against valve housing 234, as upper check valves 240 are closed, moving swivel mandrel 232 and balls 230 to positions $d_1$ in slot 228, where they shoulder on ends of the slot 228 at the time valve housing 234 has reached the end of its upward travel. As valve ball 130 is already in its closed position, the travel of ratchet balls 230 in slot 228 does not rotate it or move ratchet mandrel 222.

When the annulus is again pressured up, valve housing 234 moves downwardly again and balls 230 shoulder in slot 228 at positions $e_1$, opening valve ball 130. The movement from positions $d_1$ to $e_1$ is the beginning of a position sequence in the ratchet slot 228 which may be employed to conduct flow tests of the well by cycling annulus pressure to open and close valve ball 130 until a final pressure increase causes ratchet balls 230 to reach positions $e_6$, by which time the valve ball 130 has been opened and the well flowed six times.

A subsequent decrease in annulus pressure leaves valve ball 130 in the open position, as ratchet balls 230 do not shoulder on slot 228 as they move up to positions a again before check valves 240 dump fluid to equalize pressure as valve stems 241 contact shoulder 243. A subsequent increase in pressure causes valve housing 234 and ratchet ball 230 movement to position $b_2$, while the next decrease moves balls 230 to position $b_1$, closing valve ball 130 as ratchet balls 230 shoulder in slot 228, moving ratchet mandrel 222 upwardly. The foregoing sequence may be repeated an infinite number of times, as desired.

It is apparent from the foregoing description that if tester valve 17 is run into a well bore with ratchet balls 228 in position a, the test string can be filled as valve ball 130 will remain in the open position during the run-in pressure increase.

Alternatively, if tester valve 17 is run in the well bore with ratchet balls 230 shouldered in the $b_1$ position, and valve ball 130 in its closed position, the run-in pressure increase will leave valve ball 130 closed as ratchet balls 230 are free to travel downward to position c in slot 228 without shouldering. A subsequent pressure increase will not change the position of valve ball 130, as valve housing 234 will not move and the pressure on both sides thereof will be equalized through open check valves 244. The next pressure reduction will move valve housing 234 upwardly and thus balls 230 to positions $d_1$, in slot 228, shouldering thereon at the same time valve housing 234 stops its travel when valves 240 open and equalize pressure again. Thus, the integrity of the drill pipe may be tested as many times as desired against closed valve ball 130 when tester valve 17 is run in with the ratchet balls in the $b_1$ positions. In addition, the casing integrity can be pressure tested without opening tester valve 17, as the ratchet balls 230 in position c will not shoulder and cycle valve ball 130.

It will be readily observed by one of ordinary skill in the art that the tester valve of the present invention provides flexibility and reliability of operation unknown in prior art tester valves. Unlike the prior art tester valves disclosed in U.S. Pat. Nos. 4,422,506, 4,429,748 and 4,537,258, the tester valve of the present invention is highly responsive to pressure increases in the well bore annulus, even if such increases are slowly transmitted to the tool as in deep, hot wells. Moreover, the operation of the tester valve of the present invention is not fluid viscosity-dependent, and annulus pressure increases are transmitted to the operating mechanism in one direction only through a single set of ports, reducing the risk of uneven pressure transmission in wells with dirty fluids therein. In addition, unlike the multimode testing tool disclosed in the aforesaid U.S. patent application Ser. No. 596,321, the valve actuating mechanism of the present invention pulls valve ball 130 away from upper seat 134 to open it, rather than pushing it, greatly reducing operating friction between valve ball 130 and upper seat 134, as well as preventing a pressure differential between the bore 132 of valve ball 130 and lower seat 138, also reducing operating friction.

While the present invention has been disclosed in terms of a preferred embodiment, it should be understood that the spirit and scope thereof is not so limited and the invention as claimed renders many additions, deletions and modifications apparent to those of skill in the art.

I claim:

1. An annulus pressure responsive tester valve comprising:

a tubular housing assembly defining an axial bore therethrough;

a valve ball rotatably disposed in said housing assembly across said bore for opening and closing said passage through said bore;

valve ball rotation means operable to pull said valve ball to an open position in response to movement of a longitudinally slidable mandrel assembly extending downwardly from said valve ball in said housing assembly;

a first substantially constant volume fluid chamber filled with a displacement fluid disposed about said mandrel assembly, said first fluid chamber being defined by upper and lower floating pistons at the top and bottom thereof, by said housing assembly on the exterior thereof and by said mandrel assembly on the upper interior and by said housing assembly on the lower interior thereof;

a valve housing longitudinally slidably disposed in and dividing said first fluid chamber and in slidable sealing engagement with said housing assembly and said mandrel assembly;

at least one longitudinal valve passage extending through said valve housing, said valve passage having a spring-biased check valve at each end thereof, said check valves facing in opposite longitudinal directions;

swivel mandrel means secured to said valve housing in rotatable relationship thereto and maintaining at least one ratchet ball in a ratchet slot on the exterior of said mandrel assembly, whereby said ratchet ball can be selectively shouldered in said ratchet slot through longitudinal movement of said valve housing to transmit said movement to said mandrel assembly;

a second, variable volume fluid chamber filled with a pressurized, substantially compressive fluid immediately below said lower floating piston and in communication with the bottom thereof, said second fluid chamber being defined by said lower floating piston at the top thereof, and by an imperforate portion of said housing assembly on the exterior, interior and bottom thereof; and port means above said upper floating piston extending from the exterior of said housing assembly to the interior thereof in substantially instantaneous communication with the top of said upper floating piston and, through said displacement fluid, with the top of said lower floating piston.

2. The tester valve of claim 1, wherein said ratchet ball may be cycled in said ratchet slot through movement of said valve housing to a position wherein an increase in annulas pressure above hydrostatic will not rotate said valve ball.

3. The tester valve of claim 2, wherein said valve ball may be left in either a closed or an open position during said increase in annulus pressure.

4. The tester valve of claim 1, wherein said check valves are openable only at the upper and lower extent of the travel of said valve housing in said housing assembly.

5. The tester valve of claim 4, wherein each of said check valves includes a longitudinally disposed valve stem and each of said check valves is opened through contact of its valve stem with a portion of said housing assembly.

* * * * *